United States Patent [19]

Pelkey

[11] Patent Number: 4,697,602

[45] Date of Patent: Oct. 6, 1987

[54] MOTOR DRIVEN BULK MATERIAL ROLL AND WRAPPING MACHINE

[76] Inventor: Terry L. Pelkey, 1104 24th Ave., NE., Minneapolis, Minn. 55418

[21] Appl. No.: 845,620

[22] Filed: Mar. 28, 1986

[51] Int. Cl.[4] ..... A24C 5/08; A24C 5/10; A24D 3/02

[52] U.S. Cl. ..... 131/51; 131/47; 131/54; 131/55; 131/58; 53/215; 493/42; 493/50

[58] Field of Search ..... 131/47, 50, 55, 54, 131/51, 58; 53/215; 493/42, 50

[56] References Cited

U.S. PATENT DOCUMENTS 3,911,933 10/1975 Crisp et al. ..... 131/51

FOREIGN PATENT DOCUMENTS 0813049 3/1937 France ..... 131/51

*Primary Examiner*—V. Millin

*Attorney, Agent, or Firm*—Burd, Bartz & Gutenkauf

[57] ABSTRACT

A machine for rolling bulk material, such as fiber filters and tobacco, and wrapping a sheet member around the bulk material has a flexible apron connected to a roller bar which is rotated with an electric motor. The apron is located over a convex support between side walls having track slots for guiding the roller bar as it rolls up the apron and moves relative to the support. Bulk material placed on the apron adjacent the roller bar is rolled into a generally cylindrical shape within a sheet member as the apron moves over the support. The cylindrical product is discharged from the apron when the roller bar reaches the rear of the slots.

20 Claims, 12 Drawing Figures

MOTOR DRIVEN BULK MATERIAL ROLL AND WRAPPING MACHINE

FIELD OF INVENTION

Machines for rolling bulk materials and wrapping the same with sheet members comprise the general field of the invention. More particularly, the invention is directed to a cigarette rolling machine.

BACKGROUND OF INVENTION

Manually operated machines have been developed to roll and wrap material, such as tobacco, into generally cylindrical cigarettes. Examples of this type of machine are shown by Roes in U.S. Pat. No. 2,415,910, Armelin in U.S. Pat. No. 3,011,498 and Crisp et al in U.S. Pat. No. 3,911,933. The cigarette rolling machines disclosed in these patents have endless belts entrained about a plurality of parallel rollers. The rollers are movable relative to each other to allow the tobacco to be placed on the belt and rolled into a generally cylindrical configuration. Another type of cigarette rolling machine as disclosed by Blanchard in U.S. Pat. No. 2,557,407. This machine has a web attached at each end of a frame. The web extends over a support platen. A manual lever carrying a roller is pivotally mounted on the frame of the machine. The roller extends under the web and cooperates with the web to roll the tobacco and cigarette paper located in a web pocket into a generally cylindrical configuration.

SUMMARY OF INVENTION

The invention is directed to a motor driven bulk material rolling and wrapping machine. The machine has an upwardly convex curved support that includes upwardly directed side walls. A flexible apron is draped over the support between the side walls. The side walls have upwardly convex curved slots and generally linear slots extended forwardly away from the convex curved support. A roller bar extends transversely across the curved support and into the slots in the side walls. One end of the apron is secured to the roller bar, whereby on rotation of the roller bar, the apron is rolled around the roller bar and moved along a convex curved path determined by the radius of the convex curved slots. A drive means operatively connected to the roller bar rotates the roller bar and moves the roller bar along the slots. Bulk material placed on the apron adjacent the roller bar is rolled into a generally cylindrical shape within a sheet member that is placed on the apron adjacent the roller bar. The roller bar, when it reaches the rear of the slots moves the apron away from the support to discharge the completed cylindrical product from the machine.

The preferred embodiment of the machine has a generally flat base supporting a top cover or housing. The top cover has a front opening and a rear opening. A support means located in a chamber within the top cover extends between the front and rear openings. The support means has an upwardly convex curved support providing a transverse support surface that extends from the front opening to the rear opening of the top cover. Upwardly directed side walls located adjacent sides of the support surface have convex curved slots. The slots are identical in shape and have the same radius. Each side wall has a generally linear slot at the forward end of the convex curved slot that extends away from the support. A roller bar extended across the support has opposite ends projected into the slots in the side walls.

A flexible apron secured to the roller bar is draped over the support and secured to the cover adjacent the bottom of rear opening. A drive means selectively rotates the roller bar in opposite directions to roll and unroll the apron on the roller bar and moves the roller bar along the path of the convex curved slots. The drive means includes an electric motor mounted on a side wall below the support. A first gear is secured to the roller bar. A second gear is drivably connected to the electric motor. The axis of rotation of the second gear is the center of radius of the slots in the side walls. Movement of the roller means to the arcuate slot locates the first and second gears into driving engagement with each other. The motor operates to rotate the gears causing the roller bar to roll the apron about the roller bar and sheet member on the apron adjacent the roller bar and move the rolled apron along the path of said curved slots over said support. This causes the rolled bulk material to be compressed and eventually discharged from the apron adjacent the rear opening of the top cover.

The machine includes a switch means mounted on the top cover adjacent the front opening operable to connect the electric motor to a source of electric power. The electric motor is a DC electric motor connected to a DC power source, such as a battery, or AC transformer, with the switch means. The switch means has a manually movable actuator operable to control the direction of rotation of the motor. The actuator is moved to a first position wherein motor runs to roll the apron about the roller means and move the roller means in a forward direction over the convex curved support wall. When the actuator is moved to a second position, the motor runs in a reverse direction to unroll the apron from the roller means and move the roller means back to its initial position whereby the apron is draped over the support means with the aid of a return spring. The roller means is then manually moved away from the support wall along the path of the linear slots providing a transverse pocket for accommodating bulk material to be rolled into a generally cylindrical product. The machine is portable and versatile in use. It can be used to roll and wrap a variety of bulk materials, such as fibrous filtering materials, tobacco and the like into a generally cylindrical shape surrounded by a cylindrical sheet member such as paper, plastic or the like.

DESCRIPTION OF PREFERRED EMBODIMENT

Figure 1:
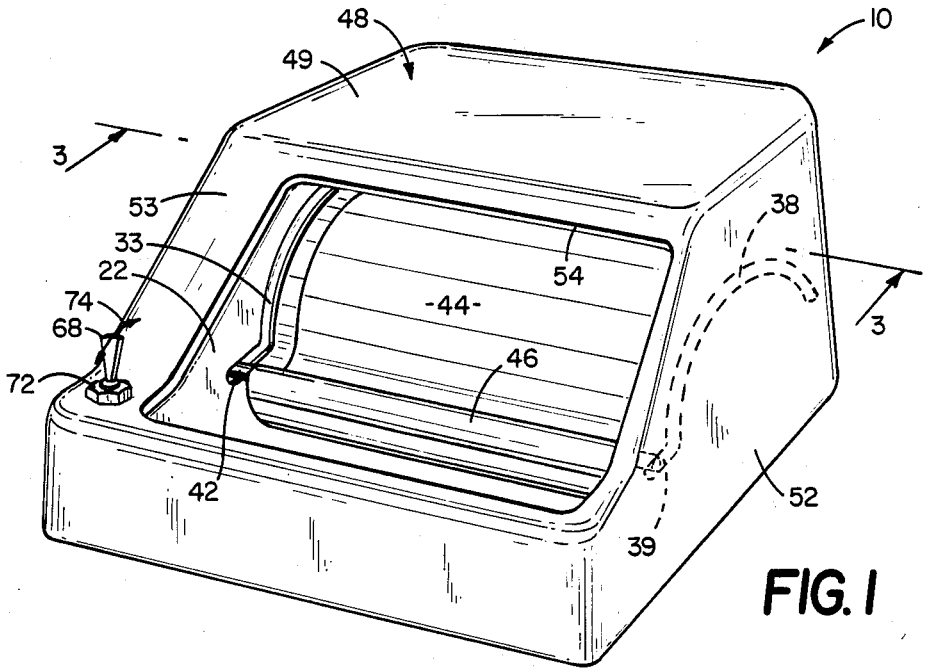
FIG. 1 is a front prespective view of the bulk material roll and wrapping machine of the invention.
Figure 2:
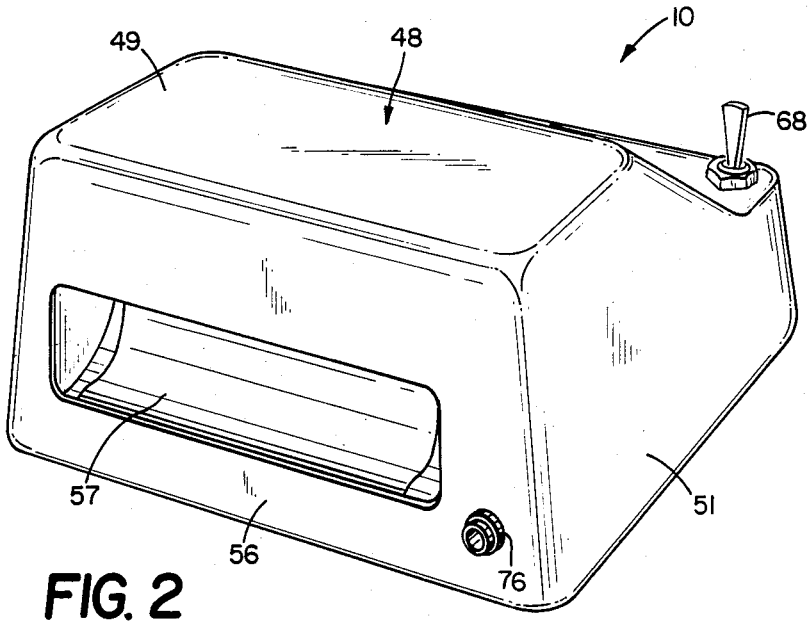
FIG. 2 is a rear perspective view of the machine of FIG. 1.
Figure 3:
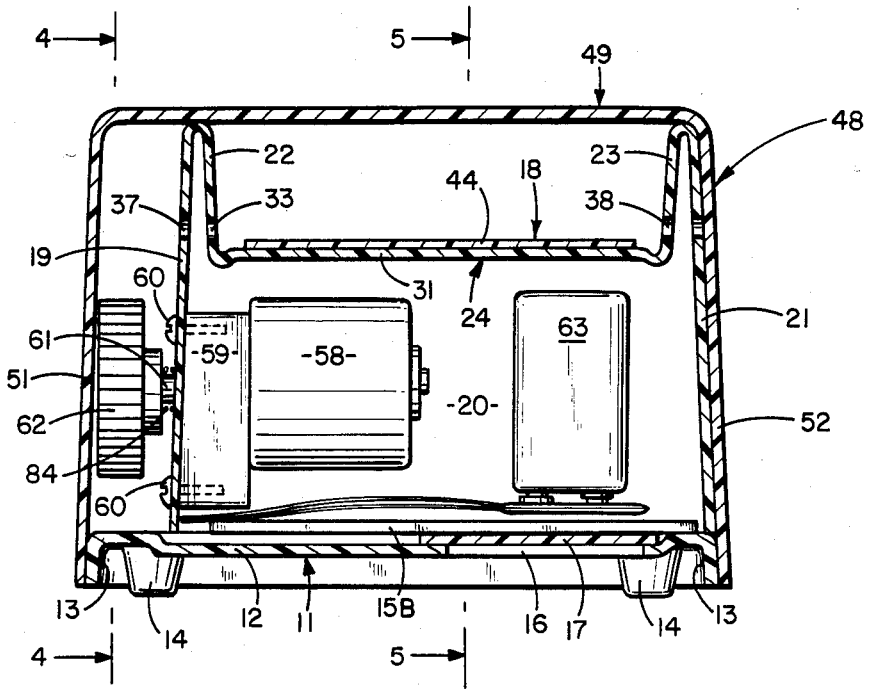
FIG. 3 is an enlarged sectional view taken along the line 3—3 of FIG. 1.
Figure 4:
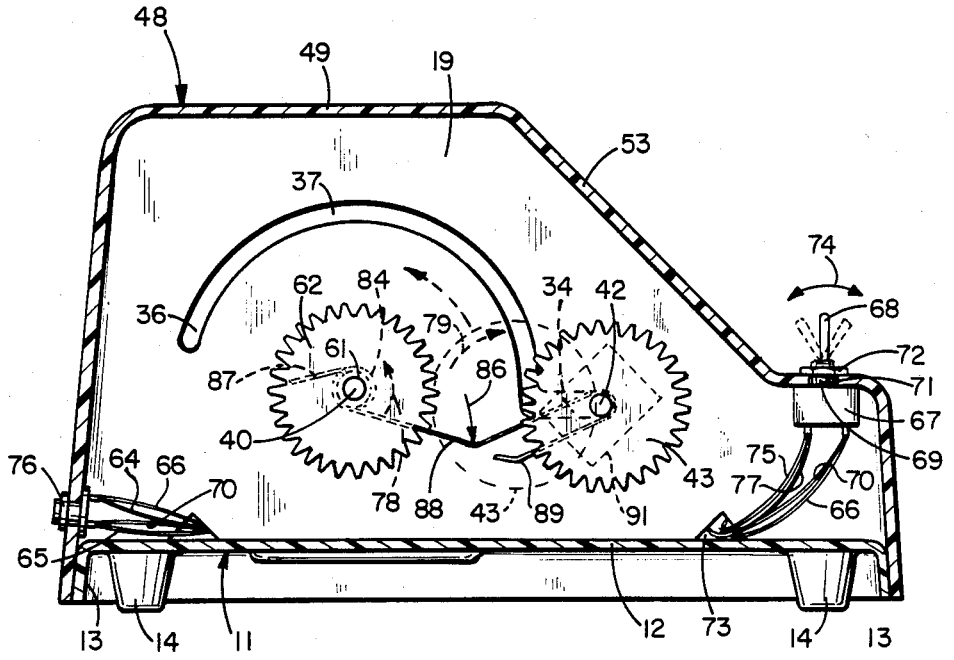
FIG. 4 is a sectional view taken along the line 4—4 of FIG. 3.
Figure 5:
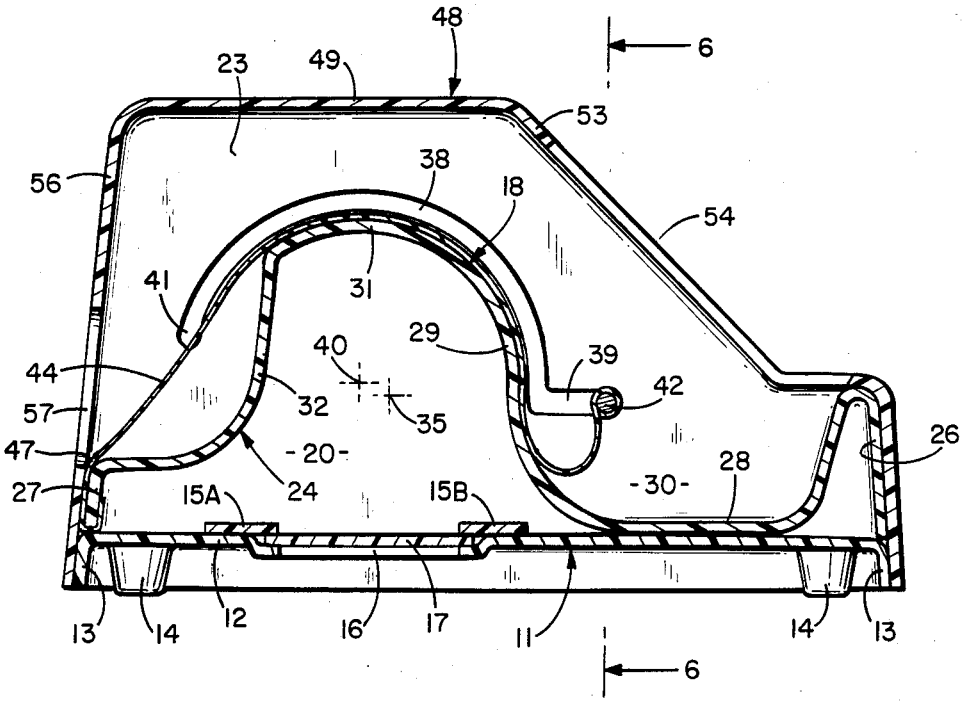
FIG. 5 is a sectional view taken along line 5—5 of FIG. 3.

Referring to FIG. 1, there is shown a roll and wrapping machine of the invention indicated generally at 10. Machine 10 is operable to roll bulk material, such as fiber filters, tobacco, and like materials into a generally cylindrical configuration about a sheet member. As shown in FIGS. 3 and 4, machine 10 has a base 11 adapted to be supported on a horizontal surface. Base 11 includes a bottom wall 12 having a downwardly directed outer peripheral flange 13. A plurality of downwardly directed feet 14 are located near the corners of bottom wall 12. Wall 12, as shown in FIGS. 3 and 5, has an opening 16 providing access to interior chamber 20 of the machine. A generally flat door 17 slidably mounted on wall 12 is movable to selectively open and close opening 16 to permit removal and replacement of a DC battery 63 from chamber 20. A pair of plates or guides 15A and 15B secured to top of wall 12 provide channels of opposite edges of door 17 whereby door 17 can be linearly moved between open and closed positions.

A support indicated generally at 18 in FIGS. 3 and 5 is located over base 11. As shown in FIG. 3, support 18 has upright side walls 19 and 21 joined to downwardly directed inside walls 22 and 23. The lower ends of inside walls 22 and 23 are joined to a reverse or S-curved support wall indicated generally at 24. Referring to FIG. 5, support wall 24 has a front lip 26 and a rear lip 27. A downwardly directed pocket wall 28 located adjacent front lip 26 forms a tray 30 for bulk material. Pocket wall 28 is joined to an upwardly cuved front wall 29 leading to a convex curved top wall 31. Top wall 31 is joined to a downwardly curved rear wall 32 connected to rear lip 27. Walls 29 and 31 have a radius center at 35. Wall 32 bends inwardly toward center 35 and curves rearwardly to rear lip 27. Walls 29, 31, and 32 form the upwardly directed convex curved support 18 having a top support surface.

Figure 6:
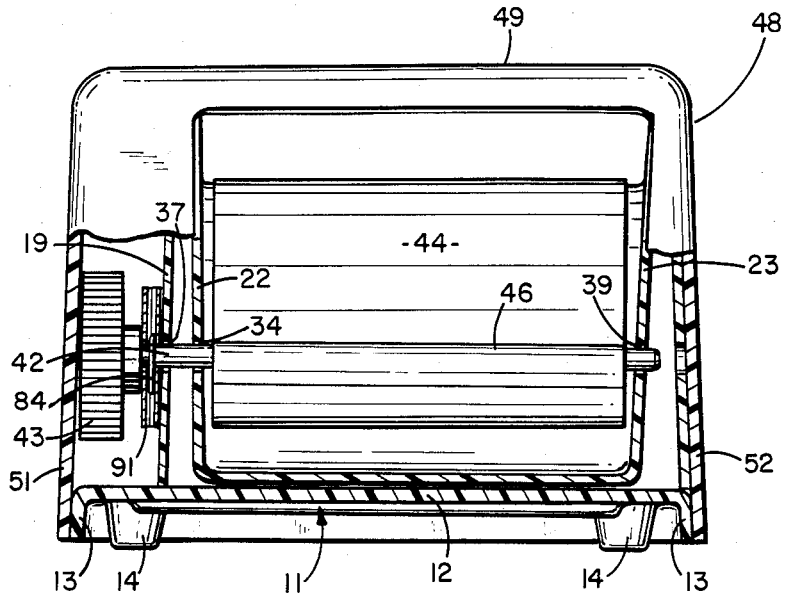
FIG. 6 is a sectional view taken along line 6—6 of FIG. 5.

Inside wall 22 has a convex curved slot 33 having a linear front slot 34 extended away from front wall 29 and a rear section 36 that diverges away from rear wall 32. Slot 33 has an arcuate curvature having a radius center at 40. Center 40 is offset upwardly from support wall center 35 whereby the radial distance between slot 33 and support walls 29 and 31 increases in a rearward direction. Side wall 19, as shown in FIG. 4, has a slot 37 that is identical in shape and aligned with slot 33. As shown in FIGS. 3 and 5, inside wall 23 has a convex curved slot 38 that generally follows the convex curvature of slot 33. Slot 38 has a linear front slot 39 extended away from front wall 29 and a rear section 41 that diverges outwardly from rear wall 32. Slot 38 is in transverse alignment with slots 33 and 37 and accommodate a linear roll bar 42. As shown in FIG. 6, roll bar 42 projects through slots 34, 37, and 39. An external spur gear 43 is secured to roll bar 42 adjacent side wall 19.

Returning to FIG. 5,a, flat flexible apron or sheet member 44 is located on top of support wall 24. Apron 44 has a forward end 46 secured to roll bar 42. The opposite end 47 of apron 44 is located adjacent rear lip 27 and fixed thereto.

A casing or top cover indicated generally at 48 and shown in FIGS. 5 and 6 is located over the support frame wall and secured to the outer peripheral flange 13 of base 11. Casing 48 has a generally top flat wall 49 joined to downwardly directed side walls 51 and 52. A front wall 53 is joined to side walls 51 and 52 and top wall 49. Front wall 53 is an access front opening 54. A rear wall 56 having a rear opening 57 is joined to the rear of the side walls 51 and 52 and top wall 49. Opening 57 extends upwardly from the outer end of rear wall 32 as shown in FIG. 5.

Figure 7:
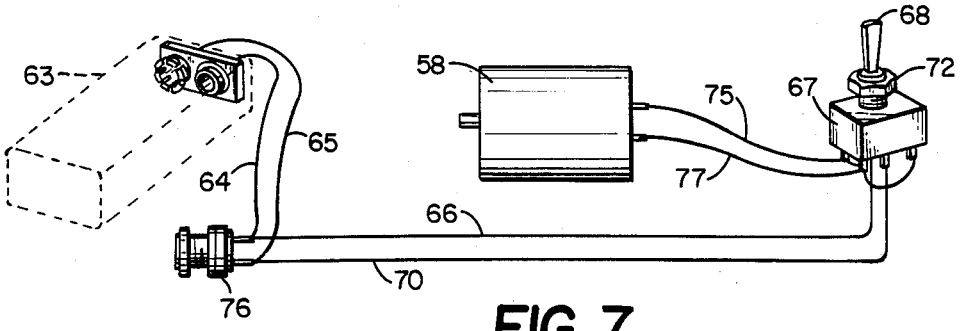
FIG. 7 is a diagram of the electrical wiring of the machine.

As shown in FIG. 3, an electric motor 58 joined to a speed reducer 59 is secured to the inside of side wall 19 with screws 60. Speed reducer 59 has a shaft 61 carrying a spur gear 62. Shaft 61 is axially aligned with radius center 40. Spur gear 62 is aligned with spur gear 43 as shown in FIGS. 3 and 4. Motor 58 is a DC electric motor that draws power from a battery 63 or AC adaptor. As shown in FIG. 7, a pair of electric conductor lines or wires 64 and 65 connect battery 63 to an adaptor 76. Wires 66 and 70 connect adaptor 76 to a switch 67. Switch 67 is a double throw double pole switch connected to electric motor 58 with wires 75 and 77. Switch 67, shown in FIG. 4, is located below front wall 53 in the left corner thereof. Switch 67 has an upwardly directed threaded neck 69 extended through a hole 71 in a top wall 53. A nut 72 secures switch 67 to top wall 53. Wires 66, 70, 75, and 77 extend from switch 67 connecting battery 63 to jack 76 through a hole 73 in the bottom of wall 19. Switch lever or actuator 68 is movable in opposite directions from a central off position, as indicated by arrow 74 in FIGS. 1 and 4, to a forward on position and a reverse on position.

As shown in FIG. 4, an electrical jack or adaptor 76 is mounted on rear wall 56 of casing 48. Adaptor 76 has a hole adapted to receive a cylindrical electrical plug leading to an external source of electric power.

As shown in FIGS. 4 and 6, a coil spring 84 located about bar 42 adjacent gear 43 biases bar 42 to its forward position as indicated by arrow 86. Spring 84 has a first arm 87 anchored to side wall 19 and a second arm 88 extended forwardly to bar 42. Arm 88 has an end 89 turned over bar 42. End 89 extends rearwardly and provides a channel allowing bar 42 to move relative to arm 88. This movement allows bar 42 to be moved along slots 34 and 39 so that gear 43 moves into driven engagement with gear 62. A folded washer 91 retains arm 88 and end 89 about bar 42.

Figure 8:
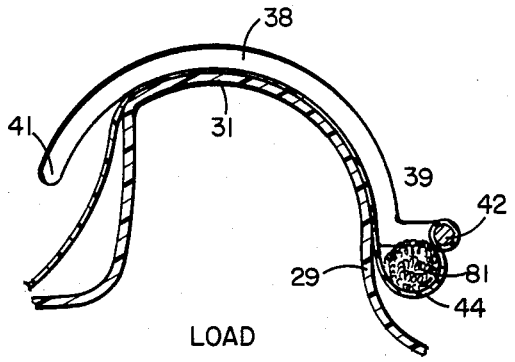
FIGS. 8 to 11 are longitudinal sectional diagrammatic views illustrating the sequence of wrapping and rolling of bulk material with the roller bar and apron of the machine of the invention.
Figure 9:
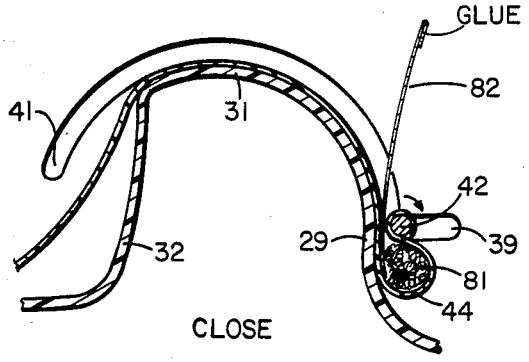

In use, pocket wall 28 is a tray for storing the bulk material, such as tobacco. As shown in FIG. 8, roll bar 42 is moved to the forward end of linear slots 34 and 39 thereby providing a transverse space or pocket between roll bar 42 and front support wall 29 for accommodating bulk material 81 on apron 44. As shown in FIG. 9, a roll bar 42 is then moved in a rearward direction closing the top of pocket until it is located adjacent front wall 29. This compresses bulk material 81 and moves it into a generally cylindrical shape. As shown in broken line in FIG. 4, spur gear 43 is moved into driving engagement with spur gear 62. Switch lever 68 is moved in a forward direction to connector motor 58 with battery 68 or other electric power source thereby driving spur gear 62 in the direction of arrow 78. This turn spur gear 43 in the direction of the arrow 79 as seen in FIG. 4. The switch lever 68 is then released thereby stopping motor 58. The operator then moistures a piece of sheet material 82, such as paper, and places it on apron 44 in back of roll bar 42 as shown in FIG. 9. The glue side of the paper is up and out. Switch lever 68 is moved in a forward direction and held in this position whereby motor 58 drives spur gear 62 and moves gear 43 in a generally arcuate direction. As shown in FIG.

Figure 10:
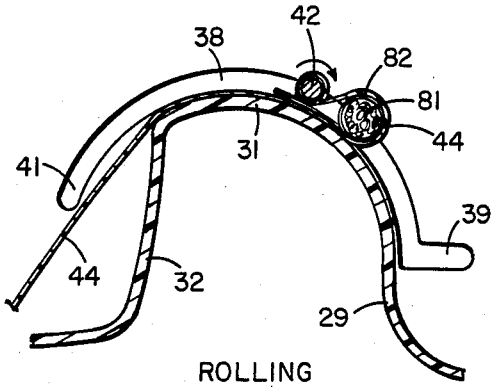
Figure 11:
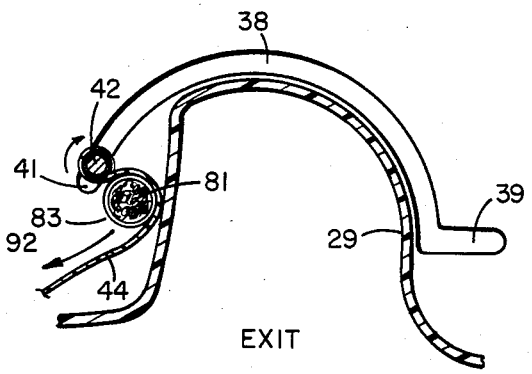
Figure 12:
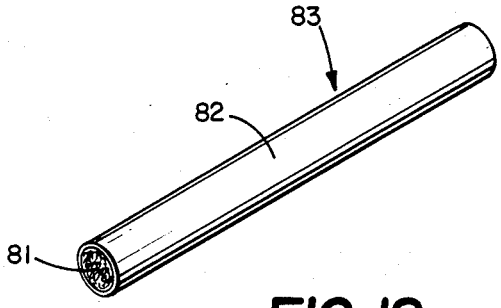
FIG. 12 is a perspective view of a cylindrical product made by the machine of the invention.

10, apron 44 is rolled up on roll bar 42. The paper 82 is rolled around material 81 forming the cylindrical product. This rolling continues as the bar 42 follows the curved path or curvature of arcuate slots 33, 37 and 38. The roll bar 42 moving rearwardly along slots 33 and 38 moves against the biasing force of spring 84. This allows spring 84 to assist the gears 43 and 62 to return roller bar 42 back to the start position. The slots 33 and 38 which diverge away from support wall 31 and 32 permit apron 44 to roll up around bar 42 without applying excessive squeezing or compression pressure on bulk material 81. As shown in FIG. 11, support wall 32 extended downwardly away from slot end 41 provides a transverse opening allowing the rolled product 83 to fall out through rear opening 57 as shown by arrow 92. Product 83, shown in FIG. 10, has sheet member 82 located about bulk material 81. Material 81 is firmly packed within the cylindrical sheet member 82.

Switch lever 68 is then moved to a reverse position. This reverses the direction of the drive of motor 58 whereby gear 43 aided with spring 87 will return roller bar 42 to its initial position adjacent the front opening 54 of housing 48 in alignment with linear slots 34 and 39. Roller bar 42 is then pulled away from ramp wall 24 providing a transverse pocket for accommodating additional bulk material.

What is claimed is:

1. A machine for rolling and wrapping bulk material with a sheet member comprising:

a base, support means mounted on the base, said support means having side wall and an upward convex curved wall joined to said side walls, each of said side walls having an upwardly curved convex slot and a generally linear forward slot extended away from said convex curved support means, said curved slot having a rear and located adjacent the rear portion of the curved support means, roller bar means extends transversely of the convex curved wall, said bar means having opposite ends extended through said slots, a flexible apron draped over said convex curved support means, said apron having a first end attached to said bar means and a second end fixed with respect to said support means, and drive means for rotating said roller bar and moving the roller bar along said slots whereby bulk material placed on said apron adjacent said roller bar is rolled into a generally cylindrical shape within a sheet member carried by the apron and discharged as a cylindrical product from the apron when the roller bar means is moved to the rear of the slots.

2. The machine of claim 1 wherein: said drive means comprises an electric motor, second gear connected to the electric motor, a first gear mounted on said roller bar, and said first gear being engageable with said second gear whereby said motor operates to rotate the roller bar and move the roller bar along said slots.

3. The machine of claim 2 including: switch means operable to connect the electric motor to a source of electric power, said switch means having an actuator movable to a first position whereby the motor runs in one direction and movable to a second position whereby the motor runs in the direction opposite the one direction.

4. The machine of claim 2 including: a cover located over said support means mounted on said base, said cover having a front opening providing access to said roller bar means and apron attached thereto and a rear opening allowing the rolled product to move out of the machine.

5. The machine of claim 4 including: switch means mounted on said cover adjacent the front opening operable to connect the electric motor to a source of electric power.

6. The machine of claim 5 wherein: said elelctric motor is a DC electric motor connectable to a DC power source with said switch means, said switch means having an actuator movable to a first position whereby said motor runs in a first direction to roll the apron about the bar means and move the bar means in a forward direction over the convex curved wall and movable to a second position whereby said motor runs in a reverse direction to unroll the apron from the bar means and move the bar means in a reverse direction over the convex curved wall.

7. The machine of claim 6 including: biasing means engageable with the roller bar means operable to bias the roller bar means and aid in moving the roller bar means toward the linear slots in the side walls.

8. The machine of claim 2 wherein: said convex curved wall has a radius center offset below the axis of rotation of said second gear, said upwardly curved convex slots having a radius center aligned with the axis of rotation of said second gear.

9. The machine of claim 8 wherein: said slots have rear end sections diverging outwardly from said convex curved wall.

10. The machine of claim 1 wherein: said support means has a front section having a downwardly directed pocket for accommodating bulk material.

11. The machine of claim 1 wherein: said base has an opening to provide access to the interior of the machine, and door means slidably mounted on said base for movement between open and closed positions relative to said opening.

12. The machine of claim 1 including: biasing means engageable with the roller bar means operable to bias the roller bar means and aid in moving the roller bar means toward the linear slots in the side walls.

13. A machine for rolling and wrapping bulk material with a sheet member comprising: a base, a cover mounted on said base surrounding a chamber, said cover having a front opening and a rear opening, support means located within said chamber extended between said front and rear openings, said support means having a convex curved wall providing a support surface, and side walls located adjacent opposite sides of said surface, each of said side walls having a convex curved slot and a generally linear slot extended away from said convex curved wall toward said front opening, roller means extended across said convex curved wall and into the slots in said side walls, flexible apron means secured to said roller means draped over the convex curved wall, said apron means being secured to said housing adjacent said rear opening in the housing, drive means including an electric motor mounted on a side wall below said convex curved wall, first gear drivably connected to the drive means rotatable upon operation of said motor, a second gear mounted on said roller means, said first gear being located in driving engagement with said second gear when the roller means is in the convex curved slots and out of engagement with said second gear when the roller means is in said linear slots, said rotation of the first gear causing the roller means to roll the apron means about the roller means and roll bulk material and a sheet member on said apron means adjacent said roller means into a cylindrical product and move the rolled apron means along said curved slots over said convex curved surface, said cylindrical product being discharged from the apron means adjacent the rear opening in said cover.

14. The machine of claim 13 including: switch means mounted on the cover adjacent the front opening operable to connect the electric motor to a source of electric power.

15. The machine of claim 13 wherein: said electric motor is a DC electric motor connectable to a DC power source with said switch means, said switch means having an actuator movable to a first position whereby said motor runs in a first direction to roll the apron means about the roller means and move the roller means in a forward direction over the convex curved wall and movable to a second position wherein said motor runs in a reverse direction to unroll the apron means from the roller means and move the roller means in a reverse direction over the convex curved wall to the generally linear slots.

16. The machine of claim 13 including: biasing means engageable with said roller means operable to bias the roller means and aid in moving the roller means toward the linear slots in the side walls.

17. The machine of claim 13 wherein: said convex curved wall has a radius center offset below the axis of rotation of said second gear, said upwardly curved convex slots having a radius center aligned with the axis of rotation of said second gear.

18. The machine of claim 17 wherein: said rear ends of said slots diverge outwardly from said convex curved wall.

19. The machine of claim 13 wherein: said ramp means has a front section having a downwardly directed recess forming a tray for accommodating bulk material.

20. The machine of claim 13 wherein: said base has an opening providing access to the interior chamber of the machine between the base and the support means and the door means slidably mounted on said base for movement between open and closed positions relative to said opening.

* * * * *